US005489345A

United States Patent [19]

Koike et al.

[11] Patent Number: 5,489,345

[45] Date of Patent: Feb. 6, 1996

[54] STEEL FOR USE IN EXHAUST MANIFOLDS OF AUTOMOBILES

[75] Inventors: Masao Koike, Ibaraki; Mitsuo Miyahara, Kobe; Kenji Higuchi, Koganei; Tomoyuki Sugino, Nagoya; Shinji Shibata, Toyota; Katsuhiko Maruyama, Amagasaki, all of Japan

[73] Assignees: Sumitomo Metal Industries, Ltd., Osaka; Toyota Jidosha Kabushiki Kaisha, Toyota, both of Japan

[21] Appl. No.: 506,256

[22] Filed: Jul. 24, 1995

Related U.S. Application Data

[63] Continuation of Ser. No. 299,795, Sep. 1, 1994, abandoned, which is a continuation of Ser. No. 992,104, Dec. 17, 1992, abandoned.

[30] Foreign Application Priority Data

Dec. 19, 1991 [JP] Japan ..... 3-336634
Sep. 21, 1992 [JP] Japan ..... 3-250850

[51] Int. Cl.[6] ..... C22C 38/22

[52] U.S. Cl. ..... 148/325; 420/61; 420/69

[58] Field of Search ..... 148/325; 420/61, 420/69

[56] References Cited

U.S. PATENT DOCUMENTS

| | | | |
|---|---|---|---|
| 3,183,080 | 5/1965 | Harpster | 420/61 |
| 3,856,515 | 12/1974 | Brandis et al. | 420/61 |
| 3,920,413 | 11/1975 | Lowery | 29/197 |
| 3,926,685 | 12/1975 | Gueussier et al. | 148/325 |
| 3,967,935 | 7/1976 | Frehn | 420/61 |
| 4,331,474 | 5/1982 | Espy | 420/57 |
| 4,360,381 | 11/1982 | Tarutani et al. | 420/42 |
| 4,869,924 | 9/1989 | Ito | 427/39 |
| 5,110,544 | 5/1992 | Sato et al. | 420/69 |
| 5,302,214 | 4/1994 | Uematsu et al. | 148/325 |

FOREIGN PATENT DOCUMENTS

| | | |
|---|---|---|
| 0435003A1 | 7/1991 | European Pat. Off. . |
| 2158943 | 5/1973 | France . |
| 55-138057 | 10/1980 | Japan . |
| 63-118011 | 5/1988 | Japan . |
| 64-8254 | 1/1989 | Japan . |
| 3-274245 | 12/1991 | Japan . |
| 2075549A | 11/1981 | United Kingdom . |
| 2084187A | 4/1982 | United Kingdom . |

*Primary Examiner*—Sikyin Ip
*Attorney, Agent, or Firm*—Burns, Doane, Swecker & Mathis

[57] ABSTRACT

A ferritic stainless steel which exhibits improved formability and which is especially useful for making 950° C. or 1000° C. exhaust manifolds is disclosed, the steel composition thereof consisting essentially of, on the basis of weight:

C: 0.02% or less, Si: 1.0% or less,
Mn: 1.0% or less, P: 0.04% or less,
S: 0.005% or less, Cu: 0.1–1.0%,
Cr: 18.0–25.0%, Mo: 1.0 (exclusive)–3.0%,
Nb: 0.1–1.0%, Al: 0.20% or less,
N: 0.02% or less, B: 0–0.01%,
C+N≦0.03%,
preferably, 21%≦Cr+Mo+Nb≦25%,
Fe and incidental impurities: balance.

21 Claims, 4 Drawing Sheets

STEEL FOR USE IN EXHAUST MANIFOLDS OF AUTOMOBILES

This application is a continuation, of application Ser. No. 08/299,795, filed Sep. 1, 1994 abandoned which is a continuation, of application Ser. No. 07/992,104, filed Dec. 17, 1992 abandoned.

BACKGROUND OF THE INVENTION

The present invention relates to a steel which exhibits improved formability and thermal fatigue resistance and which is particularly advantageous for use in exhaust manifolds of automobiles.

An exhaust manifold for an exhaust system of an automobile is exposed to high temperature exhaust gas discharged from an internal combustion engine. A material for use in making exhaust manifolds is required to be superior in many characteristics, such as oxidation resistance, high temperature strength, and thermal fatigue resistance.

Conventionally, cast iron has been used for making exhaust manifolds. Recently in order to improve engine performance as well as fuel mileage by decreased weight, welded pipes of stainless steel after shaping have been used as exhaust manifolds. An exhaust manifold made of stainless steel pipe can be 30–40% lighter than one made of cast iron.

However, typical stainless steels containing 16–18% of Cr (SUS 430 Series, ferritic stainless steels) do not exhibit a satisfactory level of oxidation resistance and high temperature strength, and they cannot be used to manufacture exhaust manifolds capable of withstanding a temperature of 900° C. or higher. Austenitic stainless steels containing 18% of Cr and 8% of Ni (SUS 304 Series) have a large thermal expansion coefficient and are easily fractured by thermal fatigue caused by thermal strains introduced when they are subjected to a repeated cycle of heating and cooling.

In view of thermal fatigue resistance and material costs, it is concluded that ferritic stainless steels are preferred to austenitic stainless steels as a material for use in making exhaust manifolds.

Japanese Patent Application Unexamined Laid-Open Specification No.64-8254/1989 discloses ferritic stainless steels containing 17–20% of Cr and 1.0% or less of Mo which are advantageous in making exhaust manifolds exhibiting improved high temperature oxidation resistance and high temperature strength.

However, the above-mentioned publication does not suggest anything about thermal fatigue characteristics, which are most important in the performance of exhaust manifolds exposed to a high temperature atmosphere at 900° C. or higher.

Summary of the Invention

An object of the present invention is to provide a stainless steel for use in an exhaust manifold, which can be used at a temperature of 900°–1050° C. Exhaust manifolds of this type will hereunder be called "950° C. exhaust manifolds" and "1000° C. exhaust manifolds".

A stainless steel from which a 950° C. or 1000° C. exhaust manifold can be manufactured must exhibit the following properties:

(1) No abnormal oxidation even when heated at 950° C., desirably 1000° C. for 100 hours.

(2) A tensile strength of 2.2 kgf/mm$^2$ or more at 950° C., desirably 1.3 kgf/mm$^2$ or more at 1000° C.

(3) Desirably, a thermal fatigue resistance enabling it to withstand 700 cycles or more before rupturing at 1000° C.

(4) An elongation of 30% or more as steel plate before forming into a welded pipe.

The formability expressed in terms of elongation of steel plate, i.e., Item (4) is a rather severe requirement because bending or elongation of a welded pipe in a severe degree is required to manufacture exhaust manifolds, and a high degree of elongation is also required even for a steel plate.

Thus, the purpose of the present invention is to provide a steel which can satisfy the above-mentioned properties (1), (2), and (4), preferably (1) through (4).

The present invention resides in a steel which exhibits improved formability as well as thermal fatigue resistance properties and which is especially useful for making exhaust manifolds, the steel composition thereof consisting essentially of, on the basis of weight:

C: 0.02% or less, Si: 1.0% or less,

Mn: 1.0% or less, P: 0.04% or less,

S: 0.005% or less, Cu: 0.1–1.0%,

Cr: 18.0–25.0%, Mo: 1.0 (exclusive)–2.0%,

Nb: 0.1–1.0%, Al: 0.20% or less,

N: 0.02% or less, B: 0–0.01%,

Fe and incidental impurities: balance wherein the content of C and N satisfies the following equation (i):

$$C+N \leqq 0.03\% \quad \text{--- (i)}$$

Preferably the steel composition contains 18.0–22.0% of Cr and 0.001 (exclusive)–0.01% of B.

In another aspect, the present invention resides in a steel which exhibits improved formability as well as thermal fatigue resistance properties and which is especially useful for making exhaust manifolds, the steel composition thereof consisting essentially of, on the basis of weight:

C: 0.02% or less, Si: 1.0% or less,

Mn: 1.0% or less, P: 0.04% or less,

S: 0.005% or less, Cu: 0.1–1.0%,

Cr: 19.0–25.0%, Mo: 1.0 (exclusive)–3.0%,

Nb: 0.1–1.0%, Al: 0.20% or less,

N: 0.02% or less,

Fe and incidental impurities: balance wherein the content of C and N satisfies the following equation (i) and the content of Cr, Mo and Nb satisfies the following equation (ii):

$$C+N \leqq 0.03\% \quad \text{--- (i)}$$

$$21\% \leqq Cr+Mo+Nb \leqq 25\% \quad \text{--- (ii)}$$

DESCRIPTION OF THE PREFERRED EMBODIMENTS

The steel composition of the present invention is characterized by the combination of suitable amounts of the before-mentioned alloying elements, and by severe restriction of impurities. In particular, the present invention is characterized by the following points.

(1) The Cr content is increased in order to improve oxidation resistance at 950° C.

Figure 1:
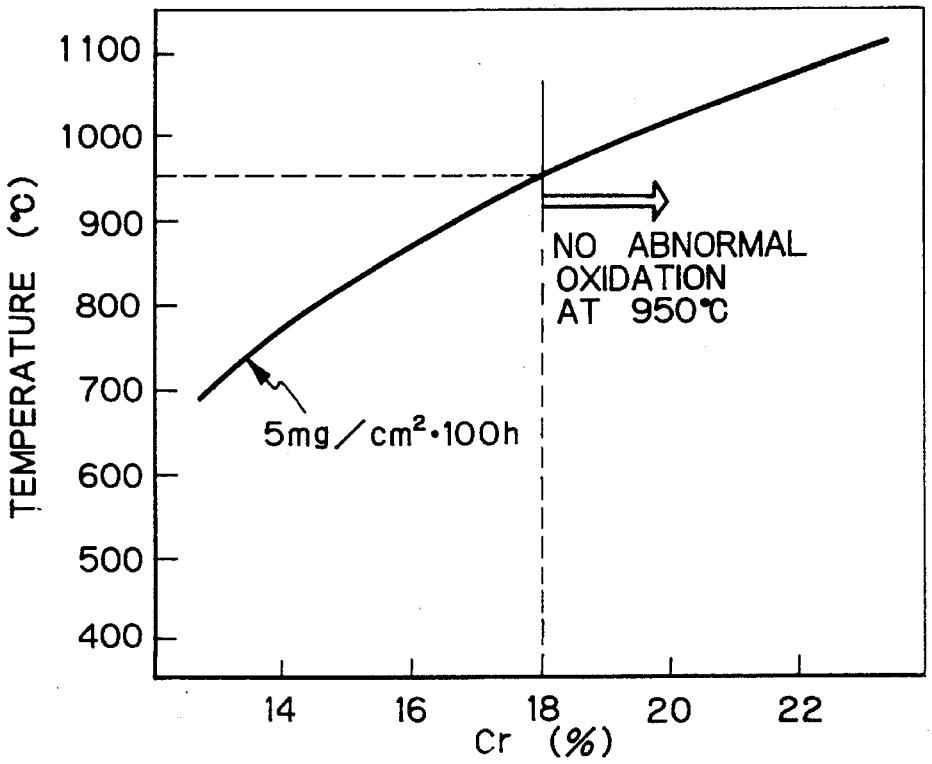
FIG. 1 is a graph showing the relationship between Cr content and oxidation resistance.

FIG. 1 is a graph showing results of an oxidation test performed on a series of steels containing 0.01% of C, 0.4% of Si, 0.4% of Mn, 0.5% of Cu, 1% of Mo, 0.5% of Nb, 0.01% of N, 0.04% of Al, 0.02% of P, and 0.002% of S with varied amounts of Cr, i.e., 12–24% of Cr. Experiments were carried out in the same manner as in the working examples, which will be described later, so as to determine the amount of Cr which is required to prevent abnormal oxidation.

"Abnormal oxidation" is oxidation of at least 5 mg/cm$^2$ when a steel is heated in atmospheric air for 100 hours. As is apparent from FIG. 1, as the content of Cr increases the temperature at which abnormal oxidation occurs will also increase. In other words, the higher the service temperature, the greater the content of Cr is necessary in order to prevent oxidation. In order to prevent abnormal oxidation at 950° C. it is necessary to add 18% or more of Cr.

(2) B is added and the Mo content is increased in order to improve high temperature strength at 950° C.

Figure 2:
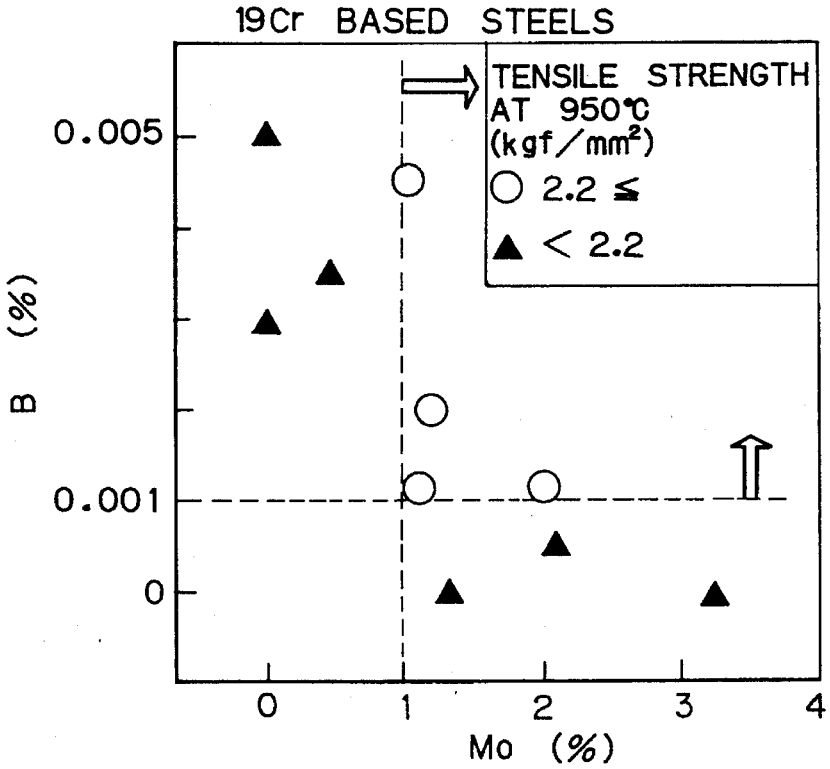
FIG. 2 is a graph showing the relationship between Mo and B contents and high temperature strength.

FIG. 2 is a graph showing results of a tension test at 950° C. for a series of steels containing 0.01% of C, 0.4% of Si, 0.4% of Mn, 0.5% of Cu, 19% of Cr, 0.5% of Nb, 0.01% of N, 0.02% of P, 0.002% of S, and 0.04% of Al with varied amounts of Mo and B, i.e., 0–4% of Mo and 0–0.005% of B. As is apparent from the graph, as the contents of Mo and B increase the high temperature strength increases markedly. It has been learned that the Mo content be increased to larger than 1.0% and the B content be increased to larger than 0.001% in order to achieve a high temperature strength of 2.2 kgf/mm$^2$ at 950° C.

(3) The lower limit in equation (i) is in order to further improve formability of steel plate.

In order to improve the formability of steel plate it is necessary to provide a mild and highly ductile structure.

Figure 3:
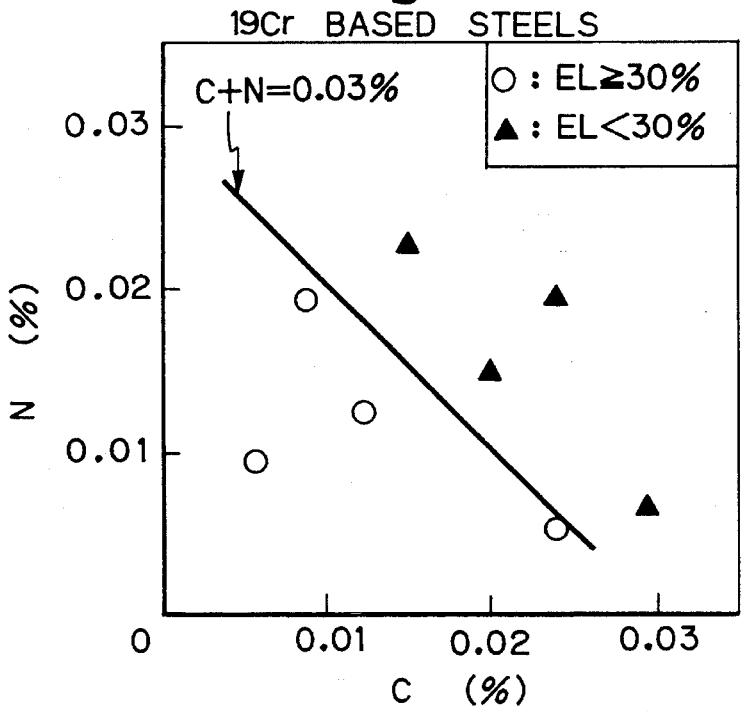
FIG. 3 is a graph showing the relationship between the content of C+N and elongation.

FIG. 3 is a graph showing the relationship between the content of C+N and the elongation for a series of steels containing 0.4% of Si, 0.4% of Mn, 0.5% of Cu, 19% of Cr, 1% of Mo, 0.5% of Nb, 0.003% of B, 0.04% of Al, 0.02% of P, and 0.002% of S with varied amounts of the content of C+N. As is apparent from the graph, the lower the content of C+N the larger the elongation. When the content of C+N is 0.03% or less an elongation of 30% or more can be assured.

In a further preferred embodiment of the present invention, steel plates of which the 1000° C. exhaust manifolds can be manufactured are provided. In this embodiment, oxidation resistance and high temperature strength at 1000° C. can be improved. Thermal fatigue resistance can be improved by restricting the total content of Cr, Mo and Nb to a limited range.

(4) The Cr content is increased in order to improve oxidation resistance at 1000° C.

Figure 4:
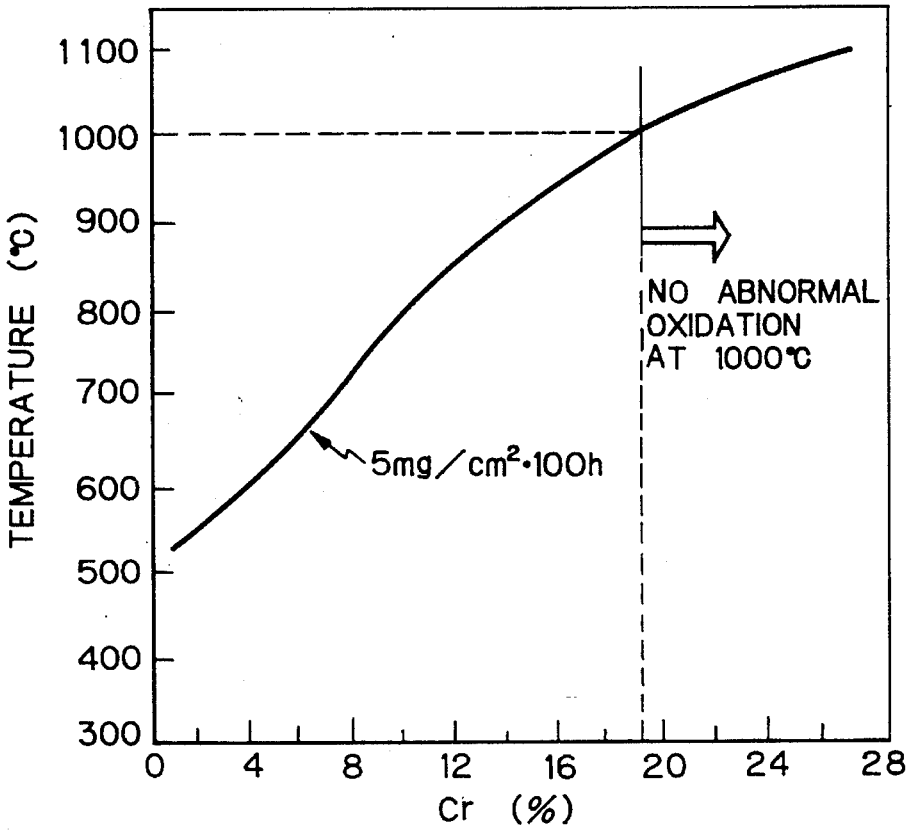
FIG. 4 is a graph showing the relationship between Cr content and oxidation resistance.

FIG. 4 is a graph showing results of an oxidation test performed on a series of steels containing 0.01% of C, 0.4% of Si, 0.4% of Mn, 0.5% of Cu, 2% of Mo, o.6% of Nb, 0.02% of P, 0.002% of S, 0.04% of Al and 0.01% of N with varied amounts of Cr, i.e., 0–24% of Cr. Experiments were carried out in the same manner as in the working examples, which will be described later, so as to determine the amount of Cr which is required to prevent abnormal oxidation.

As is apparent from FIG. 4, as the content of Cr increases the temperature at which abnormal oxidation occurs will also increase. In other words, the higher the service temperature, the greater the content of Cr is necessary in order to prevent oxidation. In order to prevent abnormal oxidation at 1000° C. it is necessary to add 19% of Cr.

(5) The Mo content is increased in order to improve high temperature strength at 1000° C.

Figure 5:
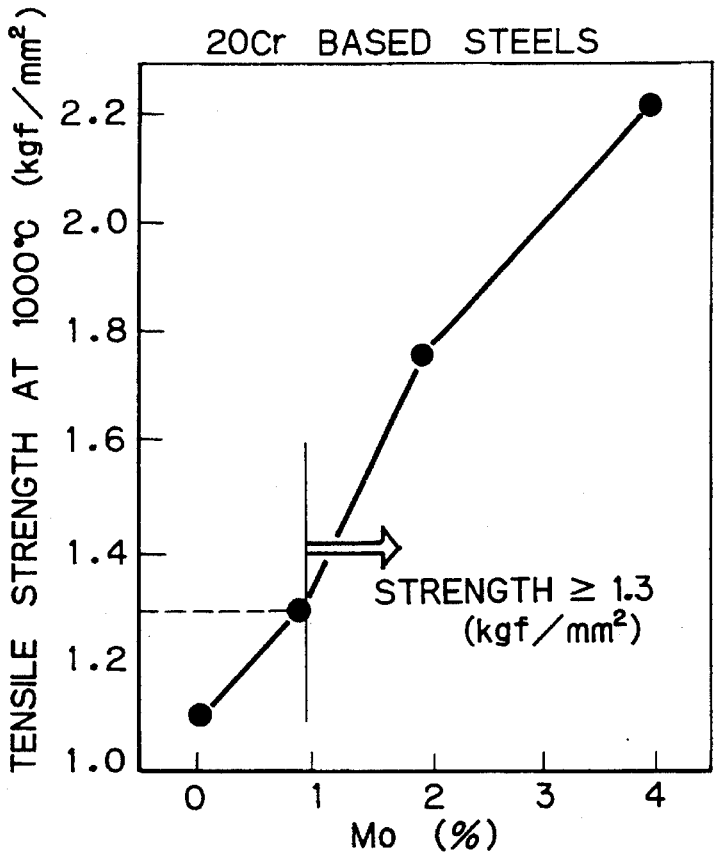
FIG. 5 is a graph showing the relationship between Mo content and high temperature strength.

FIG. 5 is a graph showing results of a tension test at 1000° C. for a series of steels containing 0.01% of C, 0.4% of Si, 0.4% of Mn, 0.5% of Cu, 20% of Cr, 0.6% of Nb, 0.02% of P, 0.002% of S, 0.04% of Al and 0.01% of N with varied amounts of Mo, i.e., 0–4% of Mo. As is apparent from the graph, as the content of Mo increases the high temperature strength increases markedly. It has been learned that the Mo content be increased to larger than 1.0% in order to achieve a high temperature strength of 1.3 kgf/mm$^2$ at 1000° C.

(6) The lower limit of equation (ii) is in order to improve thermal fatigue resistance.

Properties which affect thermal fatigue resistance include oxidation resistance, high temperature strength, and high temperature elongation in addition to the above-described thermal expansion coefficient. Thus, it has been found that since ferritic stainless steels inherently have small thermal expansion coefficients, the thermal fatigue resistance would be improved markedly when ferritic stainless steels are used, the steel composition of which contains rather large amounts of Cr and Mo, as well as Nb which is also effective for improving high temperature strength, i.e., 21%≦Cr+Mo+Nb.

(7) The lower limits in equations (i) and (ii) are in order to further improve formability of steel plate.

In order to improve the formability of steel plate it is necessary to provide a mild and highly ductile structure.

Figure 6:
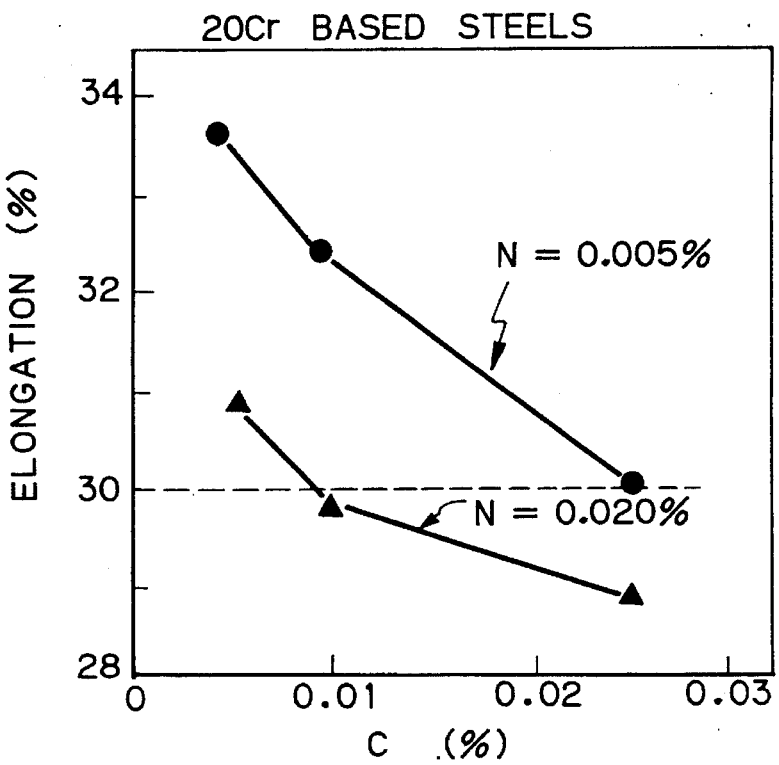
FIG. 6 is a graph showing the relationship between the content of C+N and elongation.

FIG. 6 is a graph showing the relationship between the contents of C and N and the elongation for a series of steels containing 0.4% of Si, 0.4% of Mn, 0.5% of Cu, 20% of Cr, 2% of Mo, 0.6% of Nb, 0.02% of P, 0.002% of S, and 0.04% Al with varied amounts of the content of C+N. As is apparent from the graph, the lower the content of C+N the larger the elongation. When the content of C+N is 0.03% or less an elongation of 30% or more can be assured. In addition, since the presence of such elements as Cr, Mo and Nb degrades the elongation, the total content of Cr+Mo+Nb is restricted to 25% or less. The addition of 0.1–1.0% of Cu is advantageous so as to improve ductility.

The reasons for the limits on the contents of constituent elements of a steel composition according to the present invention will be described in further detail below.

C and N:

C and N are impurities which harden the structure of steel. The smaller the contents of these elements the better. Thus, in order to guarantee an elongation of 30% or more for steel plate, the content of C is restricted to 0.02% or less and that of N is also restricted to 0.02% or less. Furthermore, the total amount of C and N is restricted to 0.03% or less, preferably to 0.02% or less.

Si and Mn:

These elements also harden the structure of steel when they are added excessively. The amount of Si is restricted to 1.0% or less and that of Mn is restricted to 1.0% or less.

P and S:

These elements are incidental impurities for steel. The presence of these elements adversely affects various properties of steel. It is desirable that the amount thereof be restricted to as small a level as possible. In the present invention, in particular, in order to prevent high temperature cracking of welds (cracking during solidification), the amount of P is restricted to 0.04% or less and that of S is restricted to 0.005% or less.

Cu:

Copper is effective for improving deep-drawability of steel plate when 0.01% or more of Cu is added. However, when the content of Cu is over 1.0%, the yield strength increases so much that formability is degraded. Thus, the content of Cu is 0.1–1.0%, preferably 0.4–0.6%.

Cr:

Cr is effective for improving oxidation resistance of steel. When 18% or more of Cr is added, there is no abnormal oxidation at 950° C. The upper limit is restricted to 22%, since steel is hardened and formability of steel plate decreases when Cr is added in an amount of more than 22%. A preferred Cr content is 19–21%.

Particularly when 19% of more of Cr is added, there is no abnormal oxidation at 1000° C. The upper limit can be extended to 25%, since steel is hardened and formability of steel plate decreases when Cr is added in an amount of more than 25% under condition that the total content of Cr+Mo+Nb is restricted to not higher than 25%. A preferred Cr content is 19–23%.

Thus, in a broad sense the Cr content is 18–25%, and it is preferable to restrict the Cr content to 18–22% when B is added. It is also preferable that the Cr content is restricted to 19–25% when B is absent.

Mo:

Mo is an important element which is effective for improving high temperature strength. As shown in FIG. 2, it is necessary to add Mo in an amount of more than 1% in the presence of B in order to achieve a target value of tensile strength of 2.2 kgf/mm$^2$ at 950° C. On the other hand, when the Mo content is over 2.0% the steel is markedly hardened, formability is decreased, and the ductility of hot-rolled steel plate is also impaired, resulting in difficulties during hot rolling. A suitable amount of Mo is larger than 1.0% but not more than 2.0%.

On the other hand, when B is not added, and high temperature properties at 1000° C. should be improved, as shown in FIG. 5, it is necessary to added Mo in an amount of more than 1% in order to achieve a target value of tensile strength of 1.3 kgf/mm$^2$ at 1000° C. However, in this case, when the Mo content is over 3.0% the steel is markedly hardened, formability is decreased, and the ductility of hot-rolled steel plate is also impaired, resulting in difficulties during hot rolling. A suitable amount of Mo is larger than 1.0% but not more than 3.0% provided that the Cr content is 19–25% and B is absent. Preferably, the Mo content is 1.5–2.5%.

Nb:

Nb serves to suppress precipitation of carbides and nitrides along grain boundaries and to improve oxidation resistance. Nb is also effective for improving high temperature strength in solid solution state. These effects of Nb are obtained when Nb is added in an amount of 0.1% or more. When the Nb content is more than 1.0%, the resulting steel is hardened. Thus, the upper limit of Nb is 1.0%.

B:

Boron is effective for improving high temperature strength. This is the same as Mo. It has been known that when B is added to austenitic stainless steels creep strength at 600°–800° C. can be increased. However, before the present invention it was not confirmed whether the addition of B to ferritic stainless steel increases high temperature strength.

As is apparent from FIG. 2 the inventors have confirmed that boron is effective for improving high temperature strength markedly even for ferritic stainless steels. An exact mechanism for this is not yet clarified, but it is supposed that since B is easily precipitated along grain boundaries, the precipitated B prevent impurities such as P and S from precipitating in the boundaries to suppress slip of grain boundaries, resulting in an increase in high temperature strength.

The addition of B itself is effective, but as shown in FIG. 2, when B is added together with Mo tensile strength at 950° C. can be improved. In order to achieve a tensile strength of 2.2 kgf/mm$^2$ or more at 950° C., it is necessary to incorporate B in an amount of larger than 0.001%. On the other hand, when the B addition is over 0.01%, formability of steel and toughness of hot-rolled steel plates are both degraded, resulting in difficulties during manufacture of steel plates. Thus, the upper limit of B content is defined as 0.01%.

It is desirable that the steel of the present invention has a tensile strength of 1.3 kgf/mm$^2$ at 1000° C. Thus, it is necessary to restrict the total content of Cr+Mo+Nb to be 21% or more in order to achieve such a high level of high temperature strength.

Al:

Al is effective for decreasing the amount of N in solid solution to lower the yield point, resulting in improvement in formability. For this purpose the upper limit of Al is 0.2%. On the other hand, when the Al content is over 0.2%, the presence of Al in a solid state decreases the ductility of the steel plate.

The steel of the present invention can be produced and worked substantially in accordance with conventional processes. Namely, first a molten steel composition is prepared using an electric furnace or converter and is refined using an AOD or VOD furnace. The molten steel is continuously cast into a continuous casting machine to form slabs or is treated by an ingot-making and breaking-down process to form slabs. The slabs are then worked by hot rolling and cold rolling into steel plates, from which welded pipes are manufactured. These welded pipes are starting materials for making exhaust manifolds. Heat treatment for the steel plates is preferably carried out under conditions including heating at 950°–1050° C. for 0.5–30 minutes, followed by air cooling.

The present invention will be described in more detail in conjunction with working examples, which are presented merely for illustrative purposes and do not restrict the present invention in any way.

Example 1

Steels having the chemical compositions shown in Table 1 were prepared in a vacuum melting furnace with a capacity of 100 kg. After forging and hot rolling, the resulting steel plates were subjected to annealing by heating 950° C. for 1 minute followed by air cooling, then after pickling cold rolled from a thickness of 6.0 mm to 2.5 mm and were subjected to finish annealing by heating at 980° C. for 1 minute followed by air cooling. The resulting hoops having a width of 400 mm were used to manufacture welded pipes for use in forming exhaust manifolds. During manufacture of the steel plates, after hot rolling the steel plates were coiled, and after cooling to room temperature the coiled steel plates were uncoiled. When cracking occurred during uncoiling, the ductility of the steel plate was evaluated as being degraded.

When welded pipes are shaped into exhaust manifolds, forging, bending and expanding must be applied to the welded pipes. In order to withstand such severe working, not only the pipes but also the plates from which the pipes are to be made must have improved formability. Formability is closely related with elongation of the plate, and it has been confirmed after a series of experiments that an elongation of 30% or more is necessary to provide a satisfactory level of formability. Thus, JIS 13B test pieces for a tension test were cut from the annealed steel plates described above to determine the elongation of the steel in the form of a plate.

In order to evaluate whether or not the steel plate is suitable for making exhaust manifolds, high temperature strength was also determined by carrying out a high temperature tension test at 950° C. using standard JIS test pieces for a high temperature tension test.

Furthermore, using the same test pieces (2.5 mm×20 mm×30 mm) cut from the finish-annealed steel plate, after grinding with #600 emery paper and being decreased, an oxidation resistance test was carried out by continuously heating the test pieces at 950° C. for 100 hours in atmospheric air to determine an oxidation gain. When the amount of oxidation gain was over 5 mg/cm$^2$, it was considered abnormal oxidation.

Test results are summarized in Table 2.

TABLE 1

| | Chemical Composition (% by weight, Fe: bal.) | | | | | | | | | | | | | |
|---|---|---|---|---|---|---|---|---|---|---|---|---|---|---|
| No. | C | Si | Mn | P | S | Cu | Cr | Mo | Nb | B | Al | N | C + N | Remarks |
| 1 | 0.010 | 0.41 | 0.35 | 0.025 | 0.003 | 0.50 | 19.1 | 1.2 | 0.55 | 0.0032 | 0.002 | 0.010 | 0.020 | Present |
| 2 | 0.005 | 0.42 | 0.34 | 0.027 | 0.002 | 0.51 | 19.3 | 1.2 | 0.49 | 0.0051 | 0.003 | 0.007 | 0.012 | Invention |
| 3 | 0.010 | 0.43 | 0.29 | 0.028 | 0.003 | 0.52 | 18.1 | 1.1 | 0.40 | 0.0025 | 0.002 | 0.011 | 0.021 | |
| 4 | 0.008 | 0.42 | 0.30 | 0.027 | 0.003 | 0.50 | 21.6 | 1.8 | 0.86 | 0.0021 | 0.004 | 0.009 | 0.017 | |
| 5 | 0.011 | 0.42 | 0.31 | 0.026 | 0.002 | 0.54 | 19.7 | 1.9 | 0.52 | 0.0030 | 0.012 | 0.010 | 0.021 | |
| 6 | 0.004 | 0.03 | 0.33 | 0.030 | 0.002 | 0.53 | 19.5 | 1.3 | 0.55 | 0.0036 | 0.010 | 0.007 | 0.011 | |
| 7 | 0.003 | 0.02 | 0.03 | 0.029 | 0.002 | 0.55 | 19.8 | 1.2 | 0.60 | 0.0042 | 0.021 | 0.004 | 0.007 | |
| 8 | 0.011 | 0.44 | 0.30 | 0.026 | 0.002 | 0.52 | 20.5 | 1.1 | 0.54 | 0.0013 | 0.009 | 0.010 | 0.021 | |
| 9 | 0.009 | 0.40 | 0.32 | 0.022 | 0.003 | 0.54 | 19.3 | 1.3 | 0.48 | 0.0081 | 0.037 | 0.012 | 0.021 | |
| 10 | 0.009 | 0.41 | 0.29 | 0.025 | 0.003 | 0.14 | 18.7 | 1.5 | 0.59 | 0.0037 | 0.011 | 0.009 | 0.018 | |
| 11 | 0.008 | 0.48 | 0.36 | 0.021 | 0.002 | 0.56 | 19.6 | 1.2 | 0.92 | 0.0041 | 0.120 | 0.007 | 0.015 | |
| 12 | 0.010 | 0.45 | 0.30 | 0.026 | 0.002 | 0.49 | 19.5 | 3.1* | 0.59 | 0.0033 | 0.004 | 0.019 | 0.009 | Compara- |
| 13 | 0.024* | 0.46 | 0.28 | 0.029 | 0.002 | 0.51 | 20.0 | 1.1 | 0.49 | 0.0030 | 0.031 | 0.025 | 0.049* | tive |
| 14 | 0.009 | 0.42 | 0.26 | 0.024 | 0.002 | 0.45 | 17.1* | 0.9* | 0.50 | 0.0044 | 0.021 | 0.009 | 0.018 | |
| 15 | 0.008 | 0.40 | 0.31 | 0.020 | 0.003 | 0.54 | 23.7* | 1.4 | 0.57 | 0.0029 | 0.007 | 0.010 | 0.018 | |
| 16 | 0.007 | 0.48 | 0.33 | 0.021 | 0.003 | 0.48 | 18.8 | 1.2 | 1.23* | 0.0042 | 0.011 | 0.008 | 0.015 | |
| 17 | 0.007 | 0.41 | 0.29 | 0.024 | 0.002 | 0.40 | 19.2 | 1.6 | 0.60 | 0.0153* | 0.024 | 0.009 | 0.016 | |

Note:
*Outside the range of the present invention.

TABLE 2

| No. | Toughness of Hot Roll Plate (Cracking during Recoiling) | Elongation (%) | High Temperature Strength (Tensile Strength at 950° C., kgf/mm$^2$) | Oxidation Resistance (Abnormal Oxidation after heating at 950° C. × 100 hrs) | Remarks |
|---|---|---|---|---|---|
| 1 | None | 33 | 2.4 | None | Present |
| 2 | " | 36 | 2.3 | " | Invention |
| 3 | " | 33 | 2.2 | " | |
| 4 | " | 30 | 2.9 | " | |
| 5 | " | 31 | 2.7 | " | |
| 6 | " | 36 | 2.3 | " | |
| 7 | " | 38 | 2.2 | " | |
| 8 | " | 35 | 2.2 | " | |
| 9 | " | 31 | 2.9 | " | |
| 10 | " | 30 | 2.3 | " | |
| 11 | " | 33 | 2.6 | " | |
| 12 | Yes* | 28* | 3.1 | " | Compara- |
| 13 | None | 26* | 2.9 | " | tive |
| 14 | " | 33 | 2.1* | Yes* | |
| 15 | " | 27* | 2.4 | None | |
| 16 | " | 28* | 2.3 | " | |
| 17 | Yes* | 29* | 2.9 | " | |

Note:
*: Inferior

In Table 1, Steel Nos. 1–11 are examples of the present invention. Steel No.1 was a typical steel of the present invention, and was good with respect to every property. Steel No. 2 had a rather small content of C+N, and it exhibited superior elongation. Steel No.3 had contents of Cr and Mo, each close to their lower limits, and had a high temperature strength of 2.2 kgf/mm$^2$, very close to the lowest, acceptable for a steel of the present invention. Steel No. 4 had contents of Cr, Mo, and Nb, each close to their upper limits, and was superior in respect to high temperature strength, but it had an elongation as a plate of 30%, very close to the lowest, acceptable level for a steel of the present invention.

Steel No. 5 had 1.9% of Mo, a rather high content of Mo, and was superior in respect to high temperature strength. Steel No. 6 had lower amounts of C, Si and N, and was superior in respect to its elongation as a plate. Steel No. 7 had a lower content of C, Si, Mn, and N, and had even higher elongation.

Steel No. 8 had Mo and B, each close to their lower limits, and was superior in respect to its elongation as a plate, but had high temperature strength, very close to the lowest, acceptable level for a steel of the present invention. Steel No. 9 had a high content of B, close to the upper limit, and was superior in respect to high temperature strength. Steel No. 10 had 0.14% of Cu, close to the lower limit, and it had an elongation of 30%, close to the lowest acceptable level for a steel of the present invention. Steel No. 11 had a Nb content of 0.92%, a rather high content, and was superior in respect to high temperature strength.

Steel Nos. 12–17 were comparative ones in which the steel compositions fell outside the range of the present invention.

Steel No. 12 had 3.1% of Mo, and it had an elongation of 28%. In addition, Steel No. 12 had a rather high content of Mo, and it had cracking during uncoiling after hot rolling, due to degradation in ductility of the hot rolled steel plate. Steel No. 13 had a C+N content of 0.049%, which was outside the range of the present invention, and it had an extremely low level of elongation, i.e., an elongation of 26%. Steel No. 14 had a lower level of Cr and Mo, and abnormal oxidation occurred during high temperature oxidation, resulting in degradation in high temperature strength. In Steel No. 15, the content of Cr is higher than that required for the present invention, and elongation is degraded. Steel No. 16 had 1.23% of Nb, much higher than the range of the present invention, with degradation in ductility, resulting in the occurrence of cracking during uncoiling.

Example 2

Steels having the chemical compositions shown in Table 3 were prepared in a vacuum melting furnace with a capacity of 100 kg. After forging and hot rolling, the resulting steel plates were subjected to annealing by heating 950° C. for 1 minute followed by air cooling, then cold rolled from a thickness of 6.0 mm to 2.0 mm and were subjected to finish annealing by heating at 980° C. for 1 minute followed by air cooling. The resulting hoops having a width of 400 mm were used to manufacture welded pipes for use in forming exhaust manifolds. Test pieces for a thermal fatigue test were cut from the welded pipes.

During manufacture of the steel plates, after hot rolling the steel plates were coiled, and after cooling to room temperature the coiled steel plates were uncoiled. When cracking occurred during uncoiling, the ductility of the steel plate was evaluated as being degraded.

Figure 7:
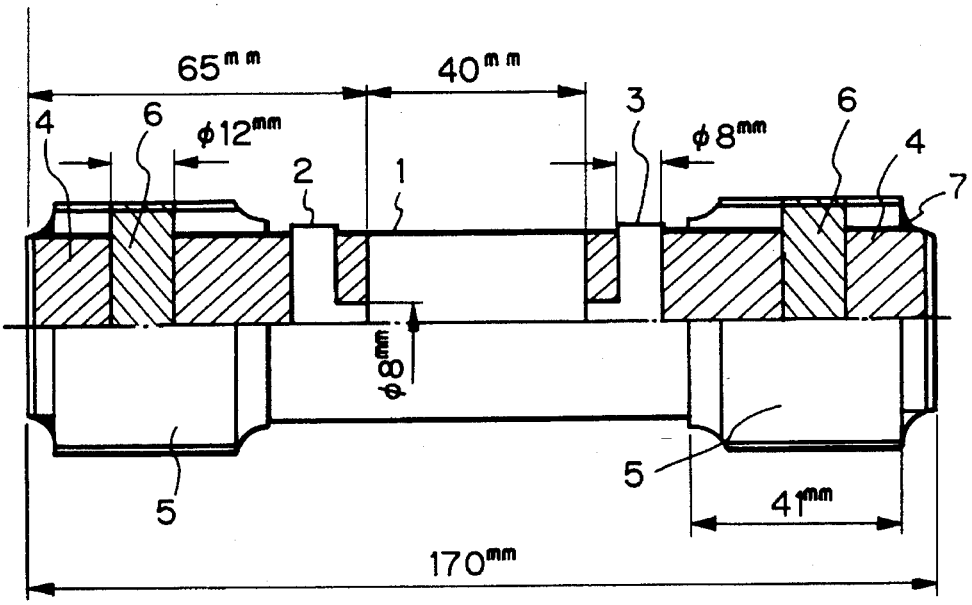
FIG. 7 is an illustration of how to carry out thermal fatigue testing and of dimensions of a test piece.

FIG. 7 shows a test piece cut from the welded pipe for a thermal fatigue test. From such welded pipes, exhaust manifolds are manufactured. In FIG. 7, a pipe 1 to be tested for thermal fatigue has two openings having a diameter of 8 mm, which serve as an air inlet 2 and outlet 3 for cooling. Reference numeral 4 indicates a holding member (mandrel) for supporting the pipe from the inside. The pipe 1 is fixed to a holder of a testing machine (not shown) through attaching member 5. The pipe 1 is fixed to the holding member 4 through a fixing pin 6 and a weld 7 at both ends.

Figure 8:
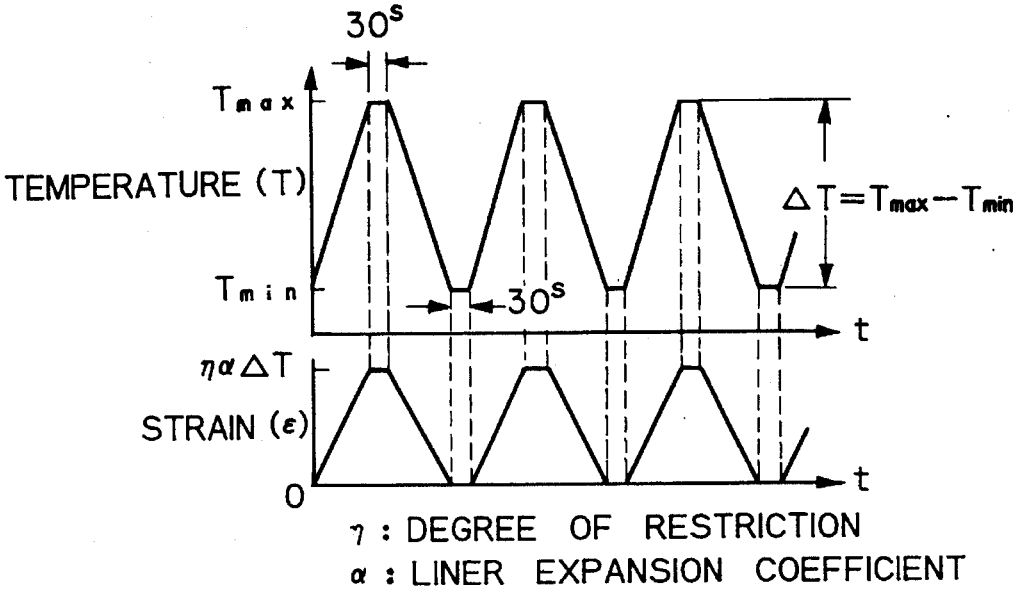
FIG. 8 is a graph showing patterns of temperature and load variation in restrained thermal fatigue testing.

The thermal fatigue test was carried out using a high temperature thermal fatigue test machine of the electrohydraulic servo system type under control of a computer. A heating cycle and application of mechanical strains were carried out according to the patterns shown in FIG. 8. Heating was carried out using a high-frequency induction heating apparatus. Cooling was performed by supplying air from the air inlet 2. The maximum heating temperature during the test was 1000° C. and the minimum temperature was 200° C. The intensity of restraint is 50%, i.e., $\eta$=0.50.

When welded pipes are shaped into exhaust manifolds, forging, bending and expanding must be applied to the welded pipes. In order to withstand such severe working, not only the pipes but also the plates from which the pipes are to be made must have improved formability. Formability is closely related with elongation of the plate, and it has been confirmed after a series of experiments that an elongation of 30% or more is necessary to provide a satisfactory level of formability. Thus, test pieces for a tension test were cut from the annealed steel plates described above to determine the elongation of the steel in the form of a plate.

Furthermore, using the same test pieces cut from the finish-annealed steel plate, an oxidation resistance test was carried out by continuously heating the test pieces at 1000° C. for 100 hours in atmospheric air to determine an oxidation gain. When the amount of oxidation gain was over 5 mg/cm$^2$, it was considered abnormal oxidation.

High temperature strength was also determined by carrying out a high temperature tension test at 1000° C.

Test results are summarized in Table 4.

TABLE 3

| | Chemical Composition (% by weight, Fe: bal.) | | | | | | | | | | | | | | |
|---|---|---|---|---|---|---|---|---|---|---|---|---|---|---|---|
| No. | C | Si | Mn | P | S | Cu | Cr | Mo | Nb | B | Al | N | C + N | Cr + Mo + Nb | Remarks |
| 1 | 0.010 | 0.41 | 0.35 | 0.025 | 0.003 | 0.50 | 20.1 | 2.1 | 0.55 | — | 0.002 | 0.011 | 0.021 | 22.8 | Present |
| 2 | 0.005 | 0.44 | 0.37 | 0.027 | 0.001 | 0.51 | 20.2 | 2.0 | 0.40 | — | 0.003 | 0.007 | 0.012 | 22.6 | Invention |
| 3 | 0.011 | 0.43 | 0.41 | 0.028 | 0.001 | 0.48 | 19.5 | 1.5 | 0.50 | — | 0.006 | 0.008 | 0.019 | 21.5 | |
| 4 | 0.008 | 0.23 | 0.23 | 0.025 | 0.002 | 0.45 | 23.2 | 1.1 | 0.45 | — | 0.003 | 0.009 | 0.017 | 24.7 | |
| 5 | 0.007 | 0.45 | 0.40 | 0.027 | 0.001 | 0.60 | 20.1 | 2.8 | 0.50 | — | 0.010 | 0.008 | 0.015 | 23.4 | |
| 6 | 0.005 | 0.02 | 0.40 | 0.025 | 0.002 | 0.53 | 20.2 | 2.3 | 0.50 | — | 0.040 | 0.007 | 0.012 | 23.0 | |

TABLE 3-continued

| No. | Chemical Composition (% by weight, Fe: bal.) | | | | | | | | | | | | | | Remarks |
|---|---|---|---|---|---|---|---|---|---|---|---|---|---|---|---|
| | C | Si | Mn | P | S | Cu | Cr | Mo | Nb | B | Al | N | C + N | Cr + Mo + Nb | |
| 7 | 0.003 | 0.03 | 0.02 | 0.020 | 0.001 | 0.51 | 19.7 | 1.8 | 0.52 | — | 0.035 | 0.004 | 0.007 | 22.0 | |
| 8 | 0.004 | 0.05 | 0.04 | 0.024 | 0.002 | 0.49 | 22.5 | 2.0 | 0.49 | — | 0.007 | 0.003 | 0.007 | 25.0 | |
| 9 | 0.010 | 0.39 | 0.36 | 0.026 | 0.002 | 0.15 | 20.2 | 2.0 | 0.51 | 0.0033 | 0.003 | 0.009 | 0.019 | 22.7 | |
| 10 | 0.007 | 0.41 | 0.38 | 0.021 | 0.001 | 0.51 | 20.3 | 2.0 | 0.97 | 0.0029 | 0.15 | 0.005 | 0.012 | 23.3 | |
| 11 | 0.010 | 0.43 | 0.30 | 0.026 | 0.002 | 0.54 | 22.0 | 3.2* | 0.61 | — | 0.003 | 0.011 | 0.011 | 25.8* | Compara- |
| 12 | 0.025* | 0.39 | 0.35 | 0.029 | 0.001 | 0.45 | 20.3 | 2.3 | 0.60 | — | 0.002 | 0.025* | 0.050* | 23.2 | tive |
| 13 | 0.009 | 0.45 | 0.41 | 0.026 | 0.001 | 0.50 | 17.5* | 1.9 | 0.40 | — | 0.001 | 0.011 | 0.020 | 19.8 | |
| 14 | 0.008 | 0.41 | 0.48 | 0.025 | 0.002 | 0.53 | 19.1 | 1.1 | 0.15 | — | 0.002 | 0.009 | 0.017 | 20.3* | |
| 15 | 0.010 | 0.18 | 0.20 | 0.029 | 0.001 | 0.50 | 20.3 | 2.2 | 1.3* | — | 0.003 | 0.010 | 0.020 | 23.8 | |

Note:
*Outside the range of the present invention.

TABLE 4

| No. | Toughness of Hot Roll Plate (Cracking during Recoiling) | Elongation (%) | Oxidation Resistance (Abnormal Oxidation after heating at 1000° C. × 100 hrs) | High Temperature Strength (Tensile Strength at 1000° C., kgf/mm$^2$) | Thermal Fatique Resistance (Number of Cycles at 1000° C. | Remarks |
|---|---|---|---|---|---|---|
| 1 | None | 32 | None | 1.8 | 855 | Present |
| 2 | " | 35 ○ | " | 1.6 | 840 | Invention |
| 3 | " | 32 | " | 1.4 ○ | 831 | |
| 4 | " | 30 | " | 2.0 ○ | 890 ○ | |
| 5 | " | 31 | " | 1.9 ○ | 875 ○ | |
| 6 | " | 36 ○ | " | 1.6 | 841 | |
| 7 | " | 38 ○ | " | 1.4 | 835 | |
| 8 | " | 36 ○ | " | 2.1 ○ | 930 ○ | |
| 9 | " | 30 | " | 1.8 | 850 | |
| 10 | " | 33 | " | 2.0 ○ | 905 ○ | |
| 11 | Yes | 28 X | " | 2.0 | 850 | Compara- |
| 12 | None | 26 X | " | 2.0 | 900 | tive |
| 13 | " | 32 | Yes | 1.4 | 675 X | |
| 14 | " | 34 | None | 1.1 X | 670 X | |
| 15 | " | 28 X | " | 1.9 | 870 | |

Note:
○: Superior, X: Inferior

In Table 4, Steel Nos. 1–10 are examples of the present invention. Steel No.1 was a typical steel of the present invention, and was good with respect to every property. Steel No. 2 had a rather small content of C+N, and it exhibited superior elongation. Steel No.3 had 21.5% of Cr+Mo+Nb, close to the lower limit, and had a high temperature strength of 1.4 kgf/mm$^2$, very close to the lowest, acceptable for a steel of the present invention. Steel No. 4 has 24.7% of Cr+Mo+ Nb, close to the upper limit, and was superior in respect to high temperature strength and thermal fatigue resistance, but it had an elongation as a plate of 30%, very close to the lowest, acceptable level for a steel of the present invention.

Steel No. 5 had 2.8% of Mo, a rather high content of Mo, and was superior in respect to high temperature strength and thermal fatigue resistance. Steel No. 6 had lower amounts of C, Si and N, and was superior in respect to its elongation as a plate. Steel No. 7 had a lower content of C, Si, Mn, and N, and had even higher elongation.

Steel No. 8 had 25.0% of Cr+Mo+Nb, close to the upper limit, and had the highest level of high temperature strength and thermal fatigue resistance. Steel No. 9 had 0.15% of Cu, close to the lower limit, and it had an elongation of 30%, close to the lowest acceptable level for a steel of the present invention. Steel No. 10 had a Nb content of 0.97%, a rather high content, and it exhibited the highest level of high temperature strength and thermal fatigue resistance.

Steel Nos. 9 and 10 were examples in which B is added with the result in improvement in high temperature strength.

Steel Nos. 11–15 were comparative ones in which the steel compositions fell outside the range of the present invention.

Steel No. 11 had 3.2% of Mo and 25.8% of Cr+Mo+Nb, and it had an elongation of 28%. In addition, Steel No. 11 had a rather high content of Mo, and it had cracking during uncoiling after hot rolling, due to degradation in ductility of the hot rolled steel plate. Steel No. 12 had a C+N content of 0.050%, which was outside the range of the present invention, and it had an extremely low level of elongation, i.e., an elongation of 26%. Steel No. 13 had a lower level of Cr, i.e., 17.5% of Cr, and abnormal oxidation occurred during high temperature oxidation, resulting in degradation in thermal fatigue resistance. In Steel No. 14, the contents of Cr, Mo, and Nb were all within the ranges for the present invention, but their total amount was 20.3%, which is above the range of the present invention. Thus, Steel No. 14 exhibited degraded high temperature strength and thermal fatigue resistance. Steel No. 15 had 1.3% of Nb, much higher than that required for the present invention, and it had a degraded elongation.

A real exhaust manifold was produced from a typical steel of the present invention, i.e., Steel No.1 of Table 1 in the form of a welded pipe having an outer diameter of 38.1 and a thickness of 2.5 mm.

The resulting exhaust manifold was subjected to a cyclic heating and cooling test using a automobile engine. According to the test results obtained by the above experiments, the endurance of the exhaust manifold of the present invention was equal or superior to conventional ones even when the temperature during testing was increased by 100°–200° C. higher than the temperature used for testing conventional exhaust manifolds.

Thus, the steel of the present invention is especially advantageous for use in high temperature exhaust manifolds for automobiles.

What is claimed:

1. An exhaust manifold which is made of a steel which exhibits improved formability as well as thermal fatigue resistance properties, the steel composition thereof consisting essentially of, on the basis of weight:

C: 0.02% or less, Si: 1.0% or less,

Mn: 0.5% or less, P: 0.04% or less,

S: 0.005% or less, Cu: 0.1–1.0%,

Cr: 18.0–25.0%, Mo: 1.0 (exclusive)–3.0%,

Nb: 0.1–1.0%, Al: 0.20% or less,

N: 0.02% or less, B: 0–0.01%,

Fe and incidental impurities: balance wherein the content of C and N satisfies the following equation (i) and the content of Cr, Mo and Nb satisfies the following equation (ii):

$$C+N \leqq 0.03\% \quad \text{--- (i)}$$

$$21\% \leqq Cr+Mo+Nb \leqq 25\% \quad \text{--- (ii), and}$$

the steel having thermal fatigue resistance enabling the steel to withstand 700 cycles or more before rupturing at 1000° C., high temperature strength of at least 1.3 kgf/mm$^2$ at 1000° C., and elongation of at least 30%.

2. An exhaust manifold as set forth in claim 1 in which Cr: 19–21%.

3. An exhaust manifold as set forth in claim 1 in which Cr: 19–23%.

4. An exhaust manifold as set forth in claim 1 in which C+N≦0.02%.

5. An exhaust manifold as set forth in claim 1 in which Cu: 0.4–0.6%.

6. An exhaust manifold as set forth in claim 1 in which Mo: 1.5–2.5%.

7. An exhaust manifold which is made of a steel which exhibits improved formability as well as thermal fatigue resistance properties, the steel composition thereof consisting essentially of, on the basis of weight:

C: 0.02% or less, Si: 1.0% or less,

Mn: 0.5% or less, P: 0.04% or less,

S: 0.005% or less, Cu: 0.1–1.0%,

Cr: 18.0–22.0%, Mo: 1.0 (exclusive)–2.0%,

Nb: 0.1–1.0%, Al: 0.20% or less,

N: 0.02% or less, B:0.001 (exclusive)–0.01%,

Fe and incidental impurities: balance wherein the content of C and N satisfies the following equation (i) and the content of Cr, Mo and Nb satisfies the following equation (ii):

$$C+N \leqq 0.03\% \quad \text{--- (i)}$$

$$21\% \leqq Cr+Mo+Nb \leqq 25\% \quad \text{--- (ii), and}$$

the steel having thermal fatigue resistance enabling the steel to withstand 700 cycles or more before rupturing at 1000° C., high temperature strength of at least 1.3 kgf/mm$^2$ at 1000° C., and elongation of at least 30%.

8. An exhaust manifold as set forth in claim 7 in which Cr: 19–21%.

9. An exhaust manifold as set forth in claim 7 in which C+N≦0.02%.

10. An exhaust manifold as set forth in claim 7 in which Cu: 0.4–0.6%.

11. An exhaust manifold which is made of a steel which exhibits improved formability as well as thermal fatigue resistance properties, the steel composition thereof consisting essentially of, on the basis of weight:

C: 0.02% or less, Si: 1.0% or less,

Mn: 0.5% or less, P: 0.04% or less,

S: 0.005% or less, Cu: 0.1–1.0%,

Cr: 19.0–25.0%, Mo: 1.0 (exclusive)–3.0%,

Nb: 0.1–1.0%, Al: 0.20% or less,

N: 0.02% or less,

Fe and incidental impurities: balance wherein the content of C and N satisfies the following equation (i) and the content of Cr, Mo and Nb satisfies the following equation (ii):

$$C+N \leqq 0.03\% \quad \text{--- (i)}$$

$$21\% \leqq Cr+Mo+Nb \leqq 25\% \quad \text{--- (ii), and}$$

the steel having thermal fatigue resistance enabling the steel to withstand 700 cycles or more before rupturing at 1000° C., high temperature strength of at least 1.3 kgf/mm$^2$ at 1000° C., and elongation of at least 30%.

12. An exhaust manifold as set forth in claim 11 in which Cr: 19–23%.

13. An exhaust manifold as set forth in claim 11 in which C+N≦0.02%.

14. An exhaust manifold as set forth in claim 11 in which Cu: 0.4–0.6%.

15. An exhaust manifold as set forth in claim 11 in which Mo: 1.5–2.5%.

16. An exhaust manifold as set forth in claim 1, having a strength of at least 2.2 kgf/mm$^2$ at 950° C.

17. An exhaust manifold as set forth in claim 7, having a strength of at least 2.2 kgf/mm$^2$ at 950° C.

18. An exhaust manifold as set forth in claim 11, having a strength of at least 2.2 kgf/mm$^2$ at 950° C.

19. An exhaust manifold as set forth in claim 1, having a weight gain of no more than 5 mg/cm$^2$ after heating in air at 950° C. for 100 hours.

20. An exhaust manifold as set forth in claim 7, having a weight gain of no more than 5 mg/cm$^2$ after heating in air at 950° C. for 100 hours.

21. An exhaust manifold as set forth in claim 11, having a weight gain of no more than 5 mg/cm$^2$ after heating in air at 950° C. for 100 hours.

* * * * *